US009901195B2

(12) United States Patent
Savage et al.

(10) Patent No.: US 9,901,195 B2
(45) Date of Patent: Feb. 27, 2018

(54) MIRROR ASSEMBLY

(71) Applicant: BOBRICK WASHROOM EQUIPMENT, INC., North Hollywood, CA (US)

(72) Inventors: David Savage, Durant, OK (US); Paul Manneck, Los Angeles, CA (US)

(73) Assignee: BOBRICK WASHROOM EQUIPMENT, INC., North Hollywood, CA (US)

( * ) Notice: Subject to any disclaimer, the term of this patent is extended or adjusted under 35 U.S.C. 154(b) by 8 days.

(21) Appl. No.: 14/747,286

(22) Filed: Jun. 23, 2015

(65) Prior Publication Data

US 2015/0366379 A1 Dec. 24, 2015

Related U.S. Application Data

(60) Provisional application No. 62/016,273, filed on Jun. 24, 2014.

(51) Int. Cl.

| | |
|---|---|
| ***A47G 1/16*** | (2006.01) |
| ***A47G 1/24*** | (2006.01) |
| ***A47G 1/02*** | (2006.01) |

(52) U.S. Cl.

CPC ..... *A47G 1/1606* (2013.01); *A47G 1/02* (2013.01); *A47G 1/24* (2013.01); *Y10T 29/49828* (2015.01)

(58) Field of Classification Search

CPC ..... A47G 1/24
USPC ..... 312/224, 226, 227; 248/475.1
See application file for complete search history.

(56) References Cited

U.S. PATENT DOCUMENTS

| | | | | | |
|---|---|---|---|---|---|
| 91,409 | A * | 6/1869 | Beames | A47B 67/005 | 312/227 |
| 675,154 | A * | 5/1901 | Heep | A47G 1/24 | 248/495 |
| 710,235 | A * | 9/1902 | Allen | A47G 1/16 | 211/88.01 |
| 729,631 | A * | 6/1903 | Miller | A47B 67/02 | 194/252 |
| 2,469,923 | A | 5/1949 | Jones | | |
| 2,636,417 | A | 4/1953 | Mathews | | |
| 3,332,731 | A * | 7/1967 | Penk | B60D 1/36 | 359/872 |
| 4,066,306 | A * | 1/1978 | Klinder | A47B 67/005 | 312/224 |
| 4,138,083 | A * | 2/1979 | Spiegel | A47G 1/24 | 248/474 |
| 4,602,855 | A * | 7/1986 | Frey | A47G 1/24 | 248/476 |

(Continued)

OTHER PUBLICATIONS

PCT International Search Report and Written Opinion for International Application No. PCT/US2015/037127 dated Sep. 15, 2015; 10 pages.

*Primary Examiner* — Bradley Duckworth
(74) *Attorney, Agent, or Firm* — Lewis Roca Rothgerber Christie LLP

(57) ABSTRACT

A mirror assembly including a collar including two side walls spaced apart from each other and a transverse member coupled to the two side walls, and a mirror releasably coupled to the transverse member. A method a method of installing a mirror includes mounting a collar on the wall, and mounting a mirror on the collar after it is mounted on the wall. A method of forming a collar from a strip of material.

13 Claims, 7 Drawing Sheets

(56) References Cited

U.S. PATENT DOCUMENTS

| | | | | |
|---|---|---|---|---|
| 5,685,515 | A | 11/1997 | Hoernig | |
| 8,246,126 | B1 * | 8/2012 | Weber | A47B 67/005 312/227 |

* cited by examiner

MIRROR ASSEMBLY

CROSS-REFERENCE TO RELATED APPLICATION

This application is based upon and claims priority on U.S. Provisional Application Ser. No. 62/016,273, filed on Jun. 24, 2014 and titled "Mirror Assembly," the contents of which are fully incorporated herein by reference.

BACKGROUND OF THE INVENTION

Fixed tilt mirrors are mirrors fixed to a collar extending from a rear of the mirror, which is triangular in side view. The mirror and collar form a one-piece design. In this regard, when the mirror is mounted on a wall, the mirror is tilted forward and downward. These types of mirrors are typically installed in public bathrooms such that people in wheelchairs are better able to use them to view themselves. This one-piece mirror design makes installation difficult and time consuming as the location of the hangers which are mounted on the wall to accept the mirror can only be estimated by the installer, since the installer is not able to see the location of the hanger brackets when installing the mirror on a wall.

SUMMARY OF THE INVENTION

In an example embodiment a mirror assembly is provided including, a collar including two side walls spaced apart from each other and a transverse member coupled to the two side walls, and a mirror releasably coupled to the transverse member. In another example embodiment, the transverse member includes a notch and wherein a hanger extends from behind the mirror at least of portion of which is received in the notch. In a further example embodiment, the assembly further includes a projection extending from a rear surface of the mirror and a member coupled to the collar for being rotatable to a position for engaging the projection for preventing the hanger from withdrawing from the notch. In yet a further example embodiment, the side walls are generally triangular. In an example embodiment, when mounted on a wall, the mirror tilts forward and downward.

In a further example embodiment, a method of installing a mirror on a wall is provided. The method includes mounting a collar on the wall, and mounting a mirror on the collar after it is mounted on the wall. In one example embodiment, the collar includes a cross member and the mirror includes a hanger, such that mounting the mirror on the collar includes straddling the cross-member with the hanger. In another example embodiment, the cross-member includes a notch and wherein straddling the cross-member with the hanger includes placing at least portion of the hanger within the notch. In yet another example embodiment the method also includes locking the mirror onto the collar. In a further example embodiment, a plate is coupled to a rear of the mirror, and the hanger extends from the plate and a projection extends from the plate at a location above the hanger. A rotatable member is coupled to the collar, and locking the mirror includes positioning the rotatable member over the projection for preventing upward movement of the projection and preventing the hanger from un-straddling the cross-member. In yet a further example embodiment, the method also includes forming the collar by defining two bend lines on a strip of material, bending opposite portions of the strip adjacent the bend lines along a diagonal defining a first triangular portion and a second triangular portion extending transversely from the first triangular portion, bending the strip along the two bend lines defining an upper portion there between and two side portions defined by the first triangular portions and two rear portions defined by the two second triangular portions, and attaching a cross-member to the two side portions. In yet a further example embodiment, the cross-member is attached to an end of each of the first and second side portions opposite their corresponding bend lines. In one example embodiment the method further includes bending at portion of each of the opposite portions defining a lip extending transversely from each of the first triangular portions. In another example embodiment, the method also includes attaching a second cross-member to the two lips. In yet another example embodiment, the collar includes two generally triangular side walls, wherein when the mirror is mounted on the collar it is tilted forward and downward.

In a further example embodiment, a method of forming a collar is provided including defining two bend lines on a strip of material, bending opposite portions of the strip adjacent the bend lines along a diagonal defining a first triangular portion and a second triangular portion extending transversely from the first triangular portion, bending the strip along the two bend lines defining an upper portion there between and two side portions defined by the first triangular portions and two rear portions defined by the two second triangular portions, and attaching a cross-member to the two side portions. In yet a further example embodiment, the cross-member is attached to an end of each of the first and second side portions opposite their corresponding bend lines. In one example embodiment the method further includes bending at portion of each of the opposite portions defining a lip extending transversely from each of the first triangular portions. In another example embodiment, the method also includes attaching a second cross-member to the two lips.

DETAILED DESCRIPTION

Figure 1B:
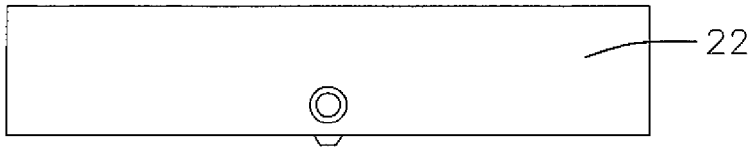
FIGS. 1A, 1B, 1C, 1D and 1E are front, top, bottom, side and rear views of an example embodiment collar.
Figure 1A:
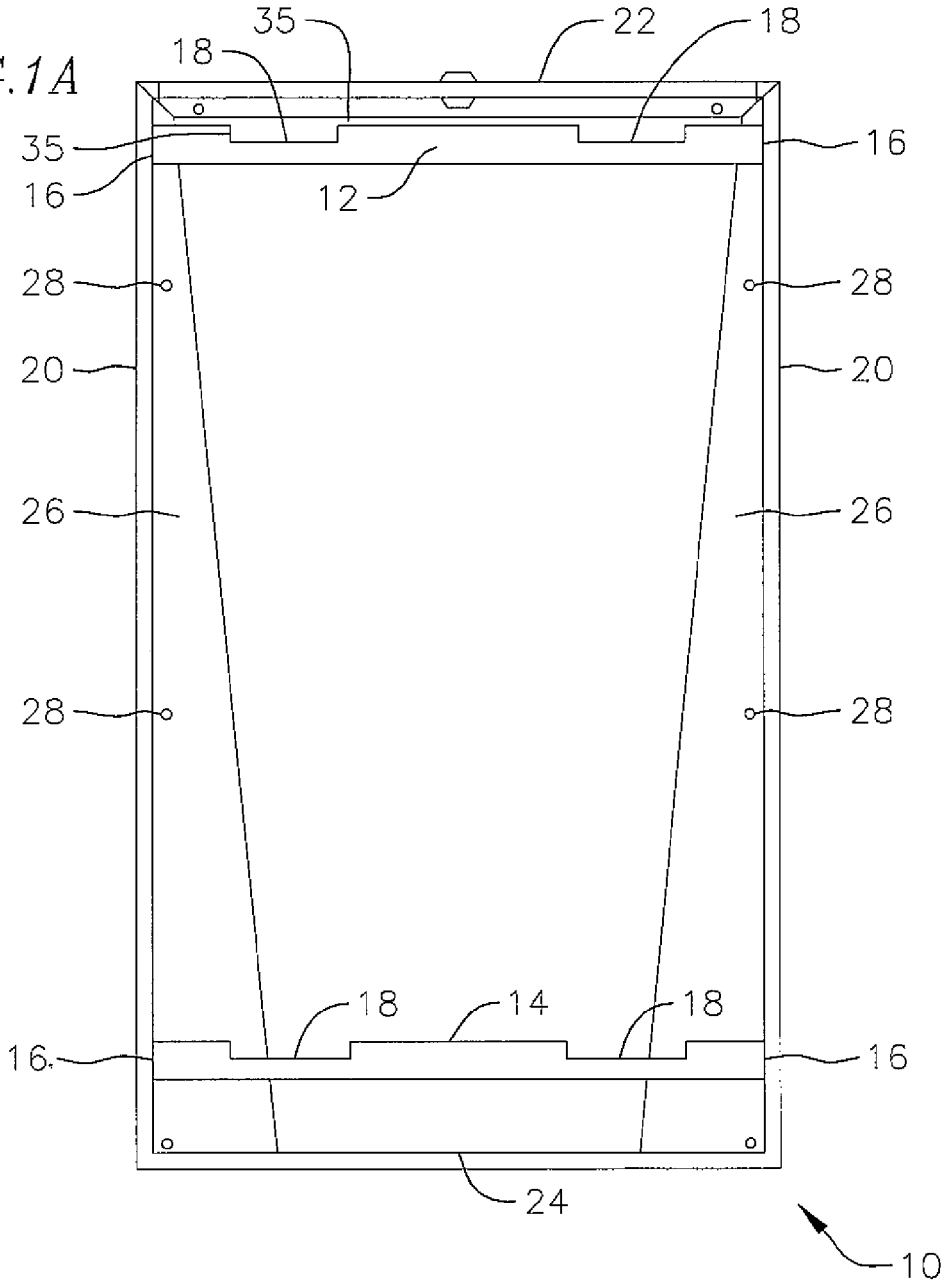
Figure 1C:
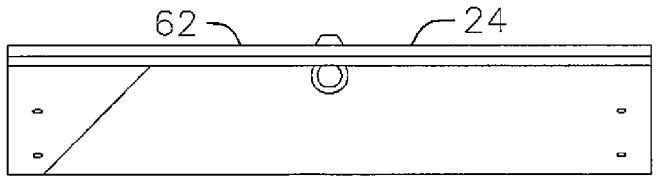
Figure 1D:
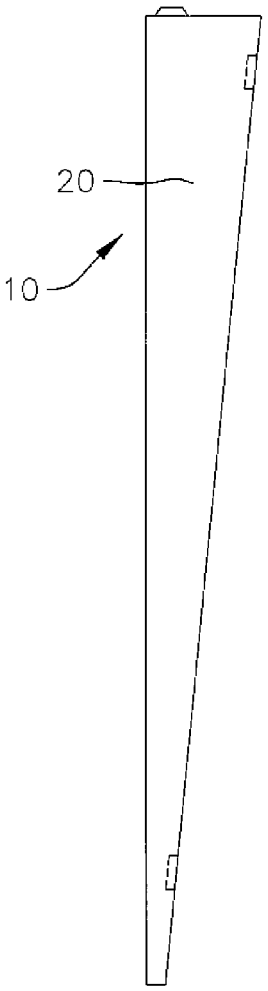
Figure 1E:
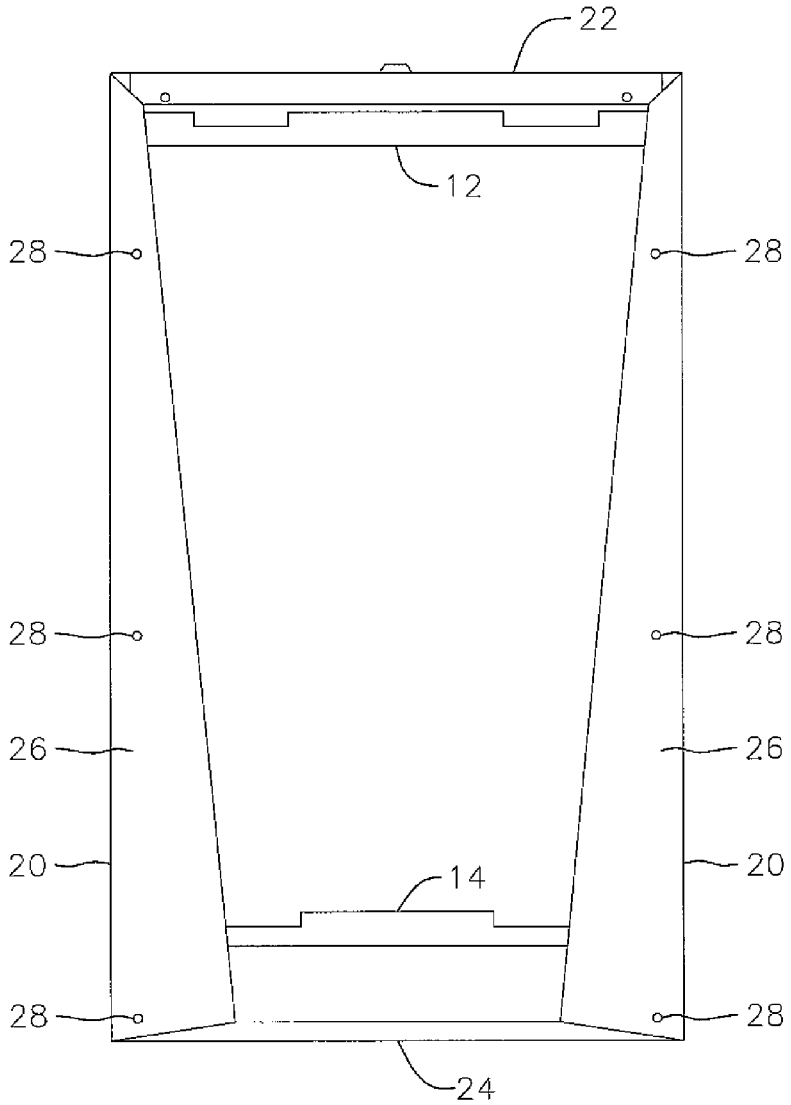

In an example embodiment, as shown in FIGS. 1A, 1B, 1C, 1D, and 1E, a collar 10 is provided that is separate from the mirror and is triangular in side view (see FIG. 1D). In an example embodiment, the collar is a metal collar. The collar includes at least one cross member 12 onto which the mirror would be mounted. In an example embodiment as shown in FIG. 1A, two cross members 12, 14 are mounted onto the collar one above the other and spaced apart. In an example embodiment, the two cross members are welded onto the collar at their ends 16. The two cross members may each be a strip of material, such as metal, extending horizontally. Each cross member may include at least one notch 18. In an example embodiment, each cross member includes two spaced apart notches 18 at a top end thereof. In an example embodiment, to provide for further strength, each cross member may be L- shaped or U-shaped in cross section. The collar includes two side walls 20 and at least one cross wall extending between the two side walls. In an example embodiment, the collar includes a top wall 22 and an bottom wall 24 both extending between the two side walls 20. In the example embodiment, each side wall 20 has a generally triangular shape in plan view (see FIG. 1D). In an example embodiment, the collar includes a back wall 26 extending from at least one of a collar side wall 20. In the shown example embodiment, a back wall 26 extends from each of the two triangular side walls 20. Openings 28 are formed through the back walls 26 to accept fasteners.

Figure 2A:
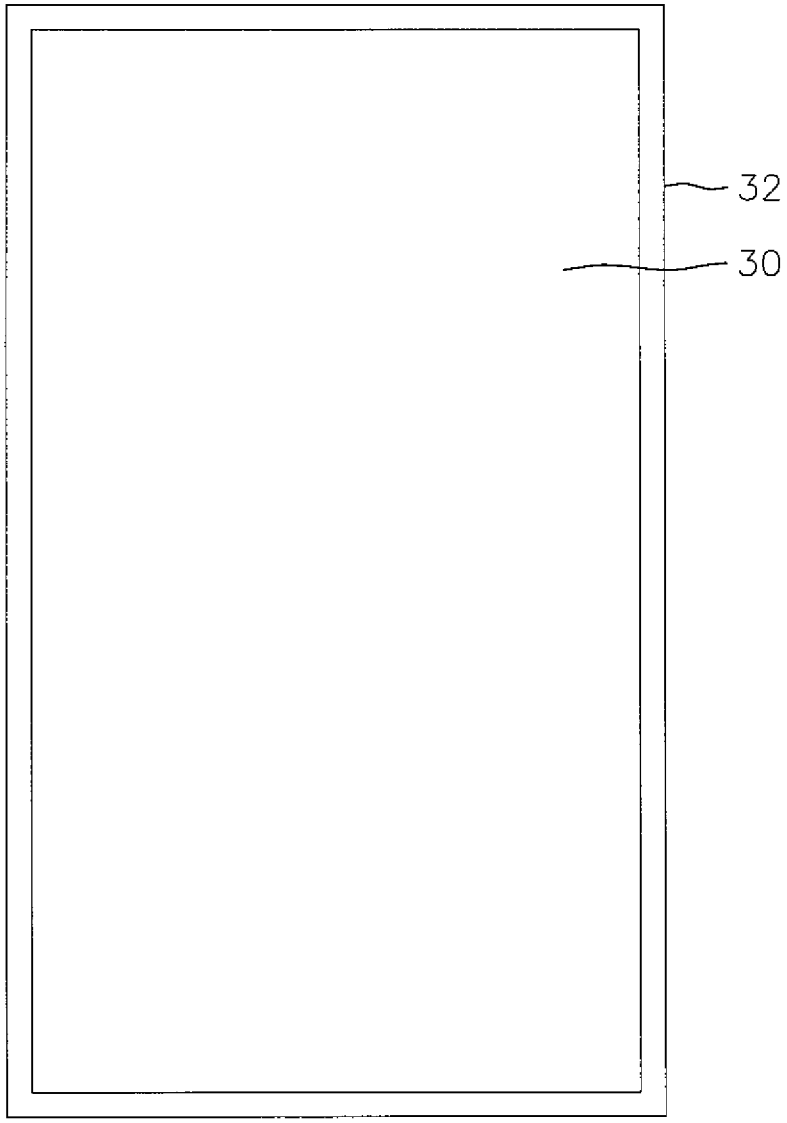
FIGS. 2A and 2B are front and rear views of an example embodiment framed mirror.
Figure 2B:
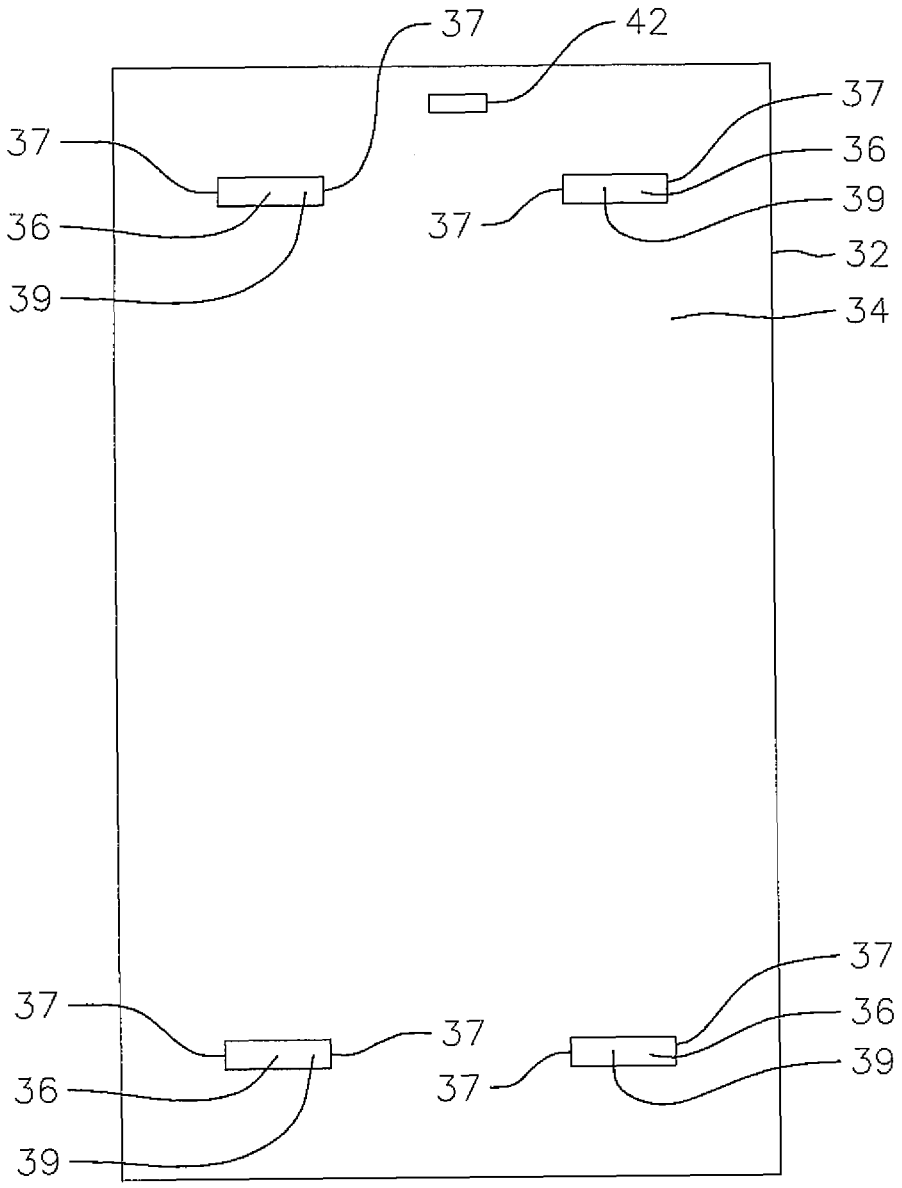
Figure 3:
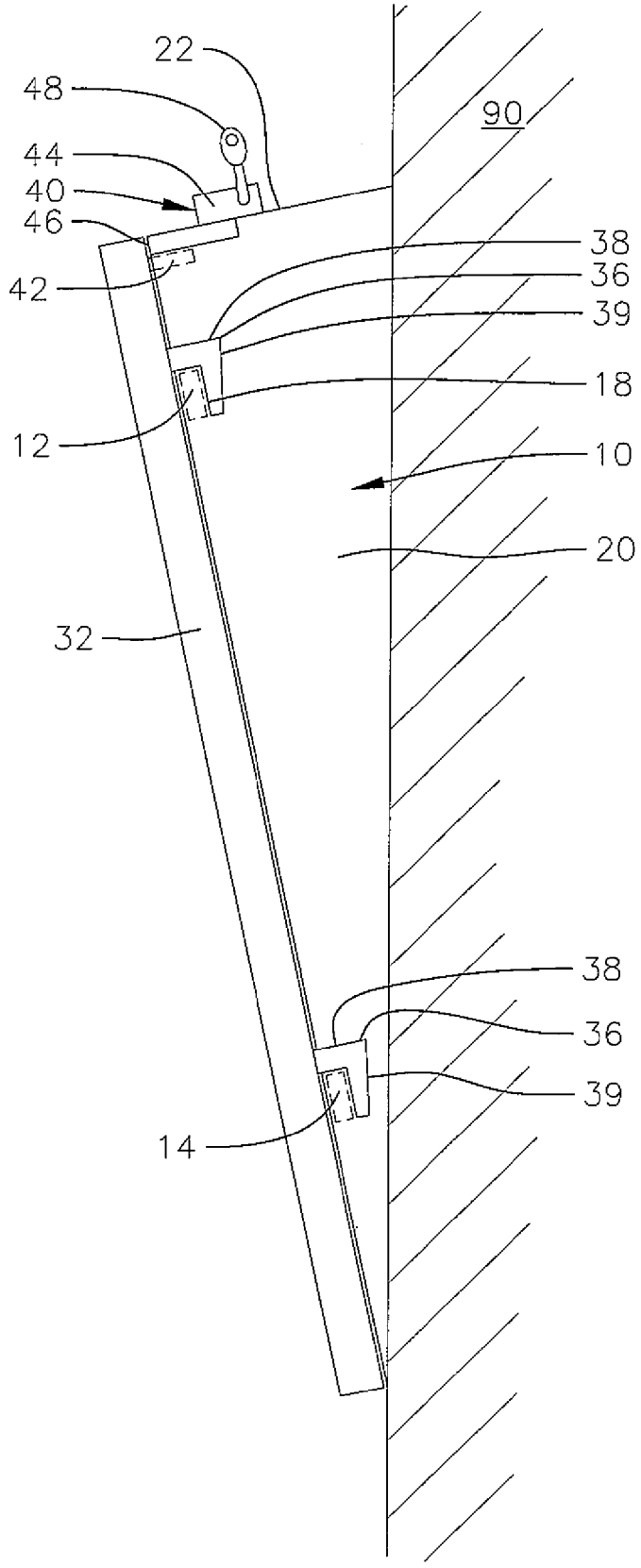
FIG. 3 is a cross-sectional view of an example embodiment mirror releasable coupled on an example embodiment collar mounted on a wall.

In an example embodiment, a mirror 30 is mounted on a frame 32 which includes a back plate 34 as shown in FIGS. 2A and 2B. The back plate includes at least a hanger 36. The back plate in an example embodiment may be separate from the frame. In an example embodiment, a hanger is provided for each notch 18 on each of the cross members. In an example embodiment, each hanger may be formed by punching or stamping out a section of the back plate. When formed, each hanger has a portion 38 extending transversely from the back plate, and a portion 39 extending downward and, in example embodiments, generally parallel to the back plate defining the hanger (FIG. 3). In another example embodiment, rather than punching or stamping out the hanger from the back plate, each hanger may be L-shaped in cross section and attached to the back plate, as for example by welding or other means. In other embodiments, the hanger may have other shapes in cross-section, as for example, a U-shape. Such hangers may be fastened or otherwise adhered to the back plate. In an example embodiments, the hangers are designed to be received in the notches 18 on the collar cross members 12, 14, such that when the hangers are received in the notches, each hanger fits within a notch and the fit is such that it provides for minimum sideward play within its corresponding notch. In other words, the side edges of each of the hangers 37 are immediately adjacent to the side edges 35 of each of the notches.

In another example embodiment, a lock mechanism 40 is provided for locking the mirror 30 onto the collar 10. The lock mechanism includes a projection 42 extending from the rear of the back plate 34. The projection may be a portion of the back plate punched or stamped out or it may be a portion welded to the back plate. When the mirror with the back plate is mounted on the cross members 12, 14, such that the hangers are received into the notches of the cross members, the projection, in an example embodiment, extends above the upper cross member 12. The lock mechanism also includes a lock 44 including a member 46 mounted on the collar 10 that can be rotated through the use of a key 48 in the lock from a position for engaging the projection or for extending above the projection so as to prevent or limit the upward movement of the projection, and thus, the mirror. In this regard, when the member is rotated into position, immediately above the projection, the mirror is prevented from moving upwards at all, or sufficiently, so that the hangers are prevented from dismounting from the cross member notches. In this regard, the mirror is retained locked onto the collar.

Figure 4:
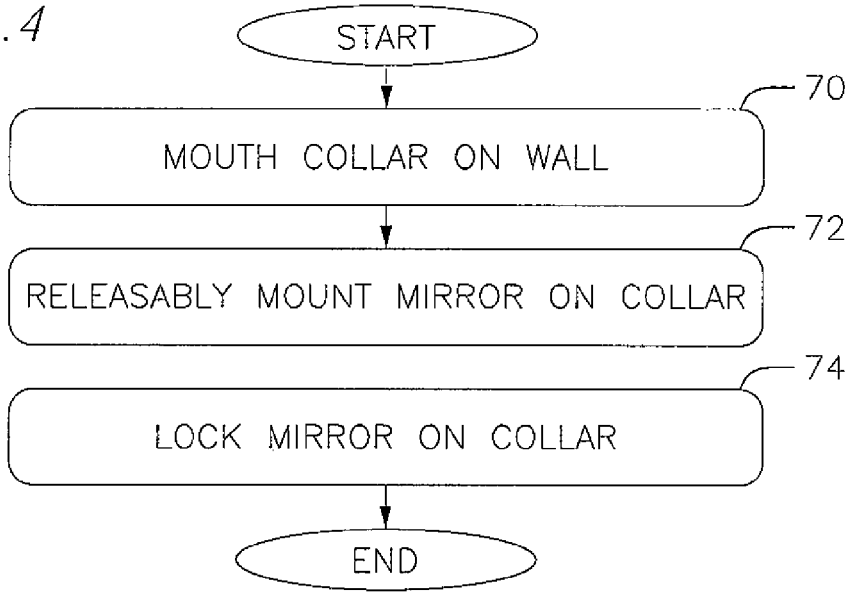
FIG. 4 is a flow-chart of an example embodiment method of attaching a mirror to a wall.

In an example embodiment, during installation, the collar is first installed onto a wall 90, as for example by fastening the collar using fasteners through the openings 28 formed through the rear walls 26 extending from the triangular sides 20 of the collar (block 70, FIG. 4). Once installed in the appropriate position, the mirror is mounted onto the collar by having the hangers extending from the rear plate of the mirror mounted onto the cross member notches (block 72). The mirror may then be locked into place with the locking mechanism (block 74). As can be seen with this embodiment, the mirror may be mounted precisely onto the desired location without having to guess where that location is, as clear viewing and access is provided to the fastening locations through the collar prior to mounting of the mirror onto the collar.

Figure 5:
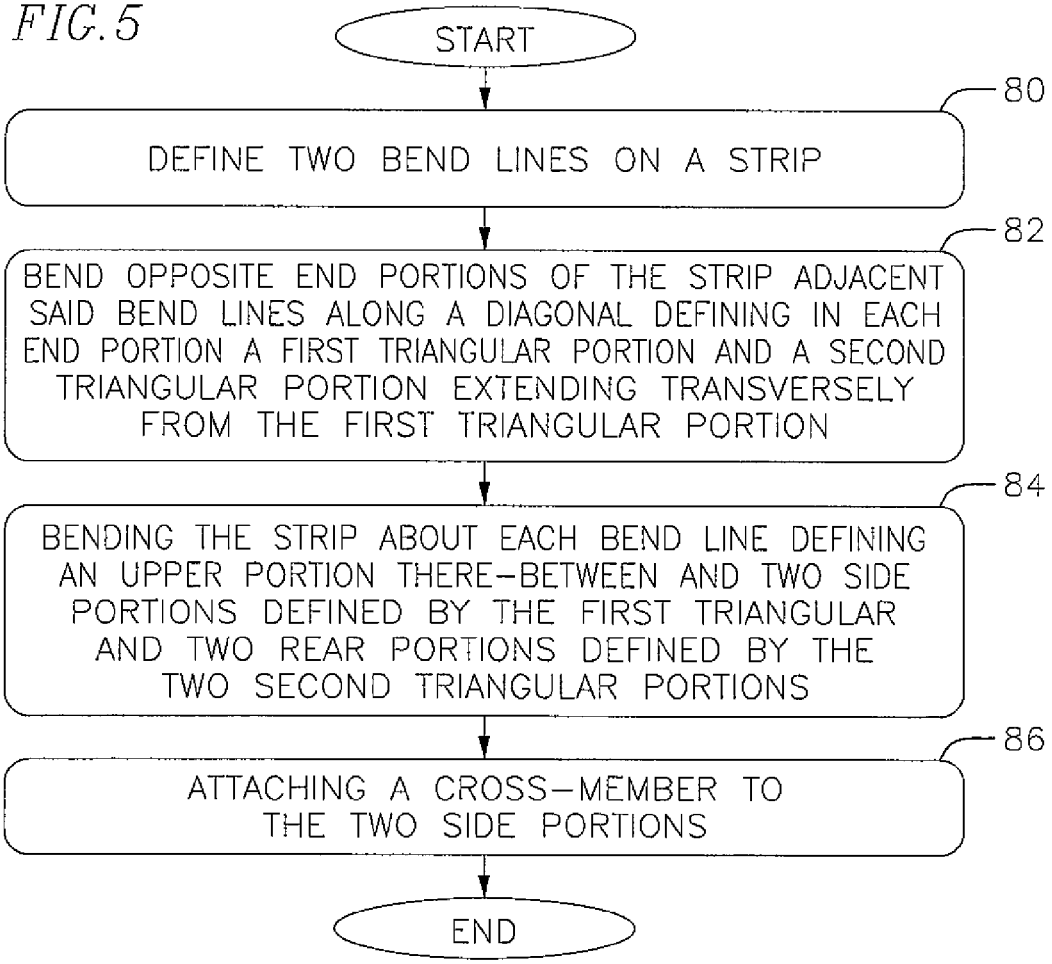
FIG. 5 is a flow-chart of an example embodiment method of forming an example embodiment collar.
Figure 6:
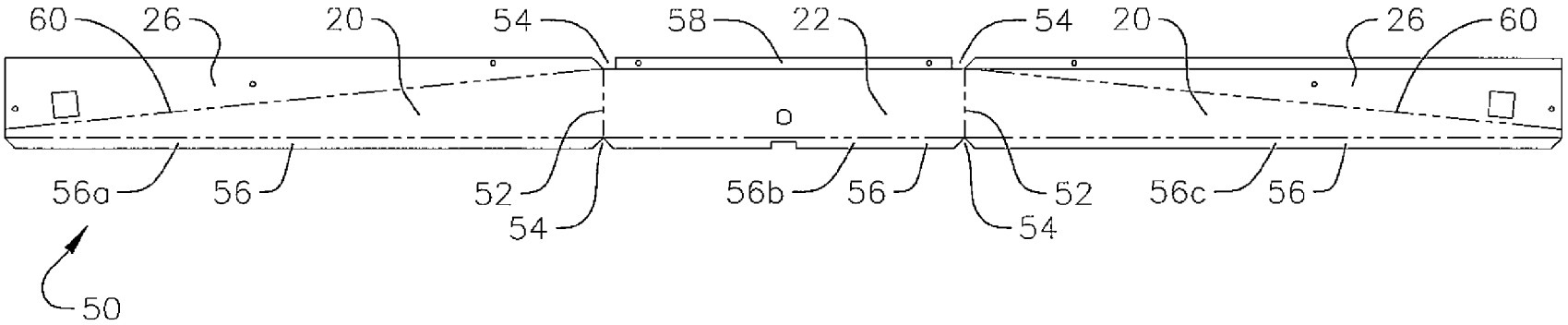
FIG. 6 is a plan view of a strip of material used to form a collar.

In one example embodiment, the collar is formed as follows. A single strip of material 50 is used to form the two triangular sides 20, as well as the upper side 22 of the collar (FIG. 6). In an example embodiment, the single strip of material has a length equal to the total sum of the lengths of the two sides 20 and the upper side 22 of the collar. This single piece of material is bent about two bend lines 52 (block 80, FIG. 5) defining the upper side 22 between each side 20 extending from opposite ends of the upper side 22. Notches 54 may be formed on opposite ends of the strip of material at the opposite ends of each bend line 52. A section 56 of the strip of material 50 along one longitudinal edge of the strip of material is bent generally perpendicularly or transversely to the rest of the strip to define a lip. In the example embodiment, the notches 54 divide the section or lip 56 into three portions or lips 56*a*, 56*b*, and 56*c* with portions 56*a* and 56*c* running along the side walls 20 and portion 56*b* running along the upper wall. The notches allow for the portions 56*a*, 56*b*, and 56*c* to bend relative to each other and the strip of material 50 to be bent about the bent lines after the section 56 of the strip in bend. A longitudinal section 58 along the upper wall 20 may also be bent perpendicularly to upper wall and in the same direction as portion 56*b*. Each portion of the strip extending from opposite ends of the portion defining the upper side is bent along a diagonal 60 to define the triangular side walls 20 and the rear walls 26 extending from the triangular side walls (blocks 82, 84). The openings 28 may be formed on the rear walls to allow for the fasteners that are used to attach the collar to a wall. A lower member may be welded to the lower ends of the side walls 20 collar so as to define the bottom wall 24. In an example embodiment, a bottom wall is not necessary as when the cross members are welded onto the side members, they may provide for sufficient stiffness and rigidity (block 86). It should be noted that the strip may be bent about the bend lines 52 before or after the triangular side walls are formed.

Although example embodiments structures described herein have been identified as being made of metal, in other example embodiments, the structures described herein may be formed from other materials, such as composites or plastics, and may be manufactured by other processes, such as molding.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operations can be practiced without meaningfully departing from the principles, spirit, and scope of this invention, as set forth in the following claims. For example, in other example embodiments, the side walls may not be triangular in side view. They may have other shapes, as for example trapezoidal or rectangular. When the side walls are rectangular, the mirror may not be a tilt mirror.

Although relative terms such as "outer", "inner", "upper", "lower", "below", "above", "front", and "back" and similar terms have been used herein to describe a spatial relationship of one element to another, it is understood that these terms are intended to encompass different orientations of the various elements and components of the device in addition to the orientation depicted in the figures.

What is claimed is:

1. A mirror assembly comprising:

a collar comprising two side walls spaced apart from each other and a cross member coupled to the two side walls, wherein the cross member comprises a notch; and a mirror releasably coupled to the cross member, wherein a hanger preformed prior to the mirror being coupled to the cross member extends from said mirror comprising a first portion extending outwardly from the mirror and a second portion extending transversely from the first portion, wherein when the mirror is releasably coupled to the cross member, the first portion of the preformed hanger penetrates the notch and at least a portion of the cross member below the notch is sandwiched between the mirror and the second portion of the preformed hanger.

2. The assembly of claim 1, further comprising a projection extending from a rear surface of the mirror, and a member coupled to the collar for being rotatable to a position for engaging the projection for preventing the hanger from withdrawing from the notch.

3. The assembly of claim 1, wherein the side walls are generally triangular.

4. The assembly of claim 1, wherein when mounted on a wall the mirror tilts forward and downward.

5. A method of installing a mirror on a wall comprising:

mounting a collar on said wall, wherein said collar comprises a cross member having a first face opposite a second face; and mounting a mirror on said collar after it is mounted on said wall, wherein a hanger preformed prior to said mounting comprises a first portion extending from the mirror and a second portion extending transversely from the first portion, and wherein mounting said mirror on said collar comprises straddling the cross member with the preformed hanger by moving the preformed hanger second portion past the cross member in a direction from the first face to past the second face.

6. The method of claim 5, wherein the cross-member comprises a notch and wherein straddling the cross-member with said hanger comprises placing at least portion of said hanger first portion within said notch such that at least a portion of the cross member below the notch is sandwiched between the second portion and the mirror.

7. The method of claim 5, further comprising locking the mirror onto the collar.

8. The method of claim 7, wherein a plate is coupled to a rear of the mirror, wherein the hanger extends from said plate and wherein a projection extends from the plate at a location above the hanger, wherein a rotatable member is coupled to the collar, and wherein locking the mirror comprises positioning the rotatable member over the projection for preventing sufficient upward movement of the projection for preventing the hanger from un-straddling the cross-member.

9. The method of claim 5, further comprising forming the collar, said forming the collar comprising:

defining two bend lines on a strip of material;

bending opposite generally rectangular portions of the strip adjacent said bend lines along a corresponding diagonal defining a first generally triangular portion and a second generally triangular portion on each of said opposite generally rectangular portions, wherein each generally triangular portion has a side along an entire of its corresponding diagonal, wherein a base of a first triangular portion of a rectangular portion extends to a first end of its corresponding diagonal and is opposite a base of the second triangular portion of said rectangular portion which extends to a second end of its corresponding diagonal opposite the first end;

bending the strip along the two bend lines defining two side portions defined by the first generally triangular portions and two rear portions defined by the two second triangular portions, and an upper portion between the two side portions; and attaching the cross-member to the two side portions.

10. The method of claim 9, wherein the cross-member is attached to an end of each of the first and second side portions opposite their corresponding bend lines.

11. The method of claim 10, further comprising bending a portion of each of said opposite rectangular portions defining a lip extending transversely from each of the first triangular portions.

12. The method of claim 11, further comprising attaching a second cross-member to the two lips.

13. The method of claim 5, wherein the collar comprises two generally triangular side walls, wherein when said mirror is mounted on said collar it is tilted forward and downward.

* * * * *